US011205555B2

(12) United States Patent
Shinkawa et al.

(10) Patent No.: US 11,205,555 B2
(45) Date of Patent: Dec. 21, 2021

(54) ELECTRON EMISSION ELEMENT AND METHOD FOR MANUFACTURING SAME

(71) Applicant: SHARP KABUSHIKI KAISHA, Sakai (JP)

(72) Inventors: Kohji Shinkawa, Sakai (JP); Tadashi Iwamatsu, Sakai (JP); Kazuya Tsujino, Sakai (JP); Reshan Maduka Abeysinghe, Sakai (JP); Tomohiro Kosaka, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 17/103,316

(22) Filed: Nov. 24, 2020

(65) Prior Publication Data

US 2021/0175039 A1 Jun. 10, 2021

(30) Foreign Application Priority Data

Dec. 9, 2019 (JP) ..... JP2019-222302

(51) Int. Cl.
*H01J 1/30* (2006.01)
*H01J 9/02* (2006.01)

(52) U.S. Cl.
CPC ..... *H01J 1/30* (2013.01); *H01J 9/022* (2013.01); *H01J 2209/012* (2013.01)

(58) Field of Classification Search
None
See application file for complete search history.

(56) References Cited

U.S. PATENT DOCUMENTS

2012/0298973 A1* 11/2012 Adachi ..... H01L 51/5228 257/40

FOREIGN PATENT DOCUMENTS

JP 2016-136485 A 7/2016

* cited by examiner

*Primary Examiner* — Ashok Patel
(74) *Attorney, Agent, or Firm* — ScienBiziP, P.C.

(57) ABSTRACT

An electron emission element of the present invention includes a lower electrode, a surface electrode, and a silicone resin layer disposed between the lower electrode and the surface electrode, wherein the surface electrode includes a silver layer, and the silver layer is in contact with the silicone resin layer.

6 Claims, 8 Drawing Sheets

ELECTRON EMISSION ELEMENT AND METHOD FOR MANUFACTURING SAME

BACKGROUND OF THE INVENTION

Field of the Invention

The present invention relates to an electron emission element and a method for manufacturing the same.

Description of the Background Art

An electron emission element provided with an intermediate layer between an electrode substrate and a surface electrode is known (see, for example, Japanese Unexamined Patent Application Publication No. 2016-136485). A silicone resin layer containing silver nanoparticles is used as the intermediate layer.

In this electron emission element, a current is allowed to pass through the intermediate layer by an electric field generated by application of a voltage between the two electrodes. At this time, some of electrons pass through the surface electrodes, and are emitted into the atmosphere. Such an electron emission element can be used as a charging device for charging a photoconductor, a light emitting device, or the like.

However, in a conventional electron emission element, silver nanoparticles may aggregate in the intermediate layer to form an aggregate. This aggregate may become a leak path of the current in the element to cause sudden breakdown of the electron emission element or reduction in life of the electron emission element. In addition, in the conventional electron emission element, silver nanoparticles are not uniformly dispersed in the intermediate layer, and therefore in an electron emission region of the surface electrode, a region where an amount of emitted electrons is large, and a region where an amount of emitted electrons is small are generated.

The present invention has been made in view of such circumstances, and provides an electron emission element having excellent electron emission characteristics and excellent life characteristics.

SUMMARY OF THE INVENTION

The present invention provides an electron emission element including a lower electrode, a surface electrode, a silicone resin layer disposed between the lower electrode and the surface electrode, wherein the surface electrode includes a silver layer, and the silver layer is in contact with the silicone resin layer.

According to the present invention, since the silver layer is in contact with the silicone resin layer, electrons can be emitted from the electron emission element even when the silicone resin layer does not contain conductive fine particles. This becomes clear by experiments conducted by inventors of the present application.

In the electron emission element of the present invention, since it is not necessary to disperse conductive fine particles in the silicone resin layer, the conductive fine particles do not aggregate or segregate in the silicone resin layer. Therefore, it is possible to suppress the sudden breakdown of the element. Further, it is possible to make effective use of an electron emission surface uniformly, and it is possible to extend the life of the electron emission element.

DESCRIPTION OF THE PREFERRED EMBODIMENTS

Figure 1:
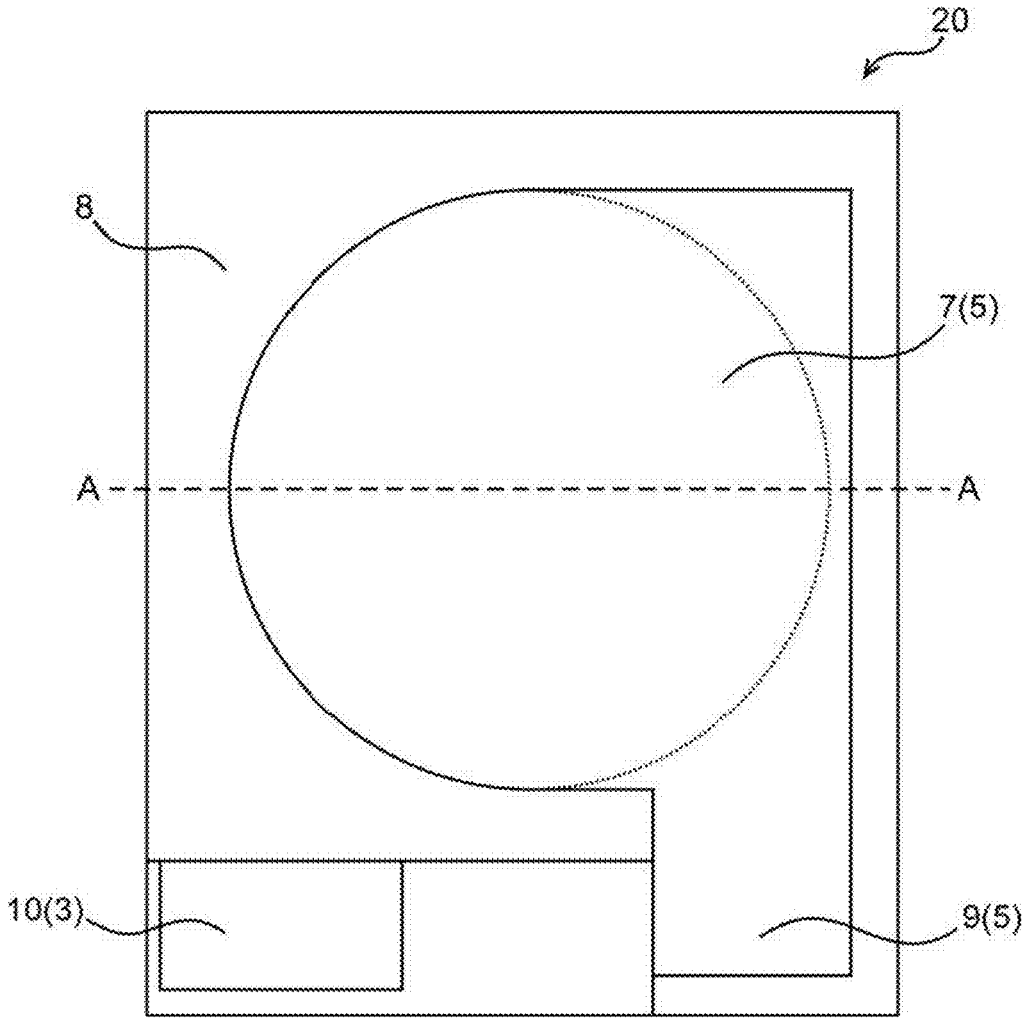
FIG. 1 is a schematic top view of an electron emission element according to an embodiment of the present invention.

An electron emission element of the present invention includes a lower electrode, a surface electrode, and a silicone resin layer disposed between the lower electrode and the surface electrode, the surface electrode includes a silver layer, and the silver layer is in contact with the silicone resin layer.

The silver layer is preferably a silver sputtering layer or a silver-deposited film. This makes it possible to control a thickness of the silver layer at a non-level.

A thickness of the silicone resin layer is preferably 0.5 μm or more and 1.25 μm or less, and a thickness of the silver layer is preferably larger than 5 nm and 30 nm or less. Consequently, the electron emission element can have excellent electron emission characteristics and excellent life characteristics.

The surface electrode is preferably a laminated electrode in which the silver layer and a gold layer or a platinum layer are laminated. This makes it possible to improve the electron emission characteristics and the life characteristics of the electron emission element.

A thickness of the gold layer or a thickness of the platinum layer is preferably 10 nm or more and 20 nm or less. This makes it possible to improve the electron emission characteristics and the life characteristics of the electron emission element.

The lower electrode is preferably disposed on a substrate, the silicone resin layer is disposed on the lower electrode, and the surface electrode is disposed on the silicone resin layer. This makes it possible to reduce the surface roughness of an electron emission surface of the electron emission element and improve the life characteristics of the electron emission element.

The present invention also provides a method for manufacturing an electron emission element including forming a silicone resin layer on a lower electrode; and forming a silver layer on the silicone resin layer so as to be in contact with the silicone resin layer, wherein the forming the silicone resin layer includes coating a silicone resin coating agent substantially not containing silver particles on the lower electrode.

The forming the silver layer is preferably forming the silver layer by using a sputtering method or a vapor deposition method.

Hereinafter, the present invention will be described in more detail with reference to a plurality of embodiments. Configurations shown in the drawings and the following description are examples, and the scope of the present invention is not limited to the configurations shown in the drawings and the following description.

First Embodiment

Figure 2:
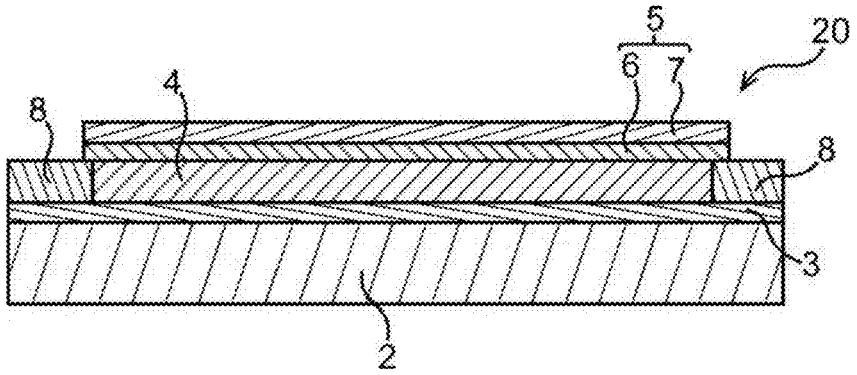
FIG. 2 is a schematic sectional view of the electron emission element taken along a broken line A-A in FIG. 1.

FIG. 1 is a schematic top view of an electron emission element of this embodiment, and FIG. 2 is a schematic sectional view of the electron emission element taken along a broken line A-A of FIG. 1.

The electron emission element 20 of this embodiment includes a lower electrode 3, a surface electrode 5, and a silicone resin layer 4 disposed between the lower electrode 3 and the surface electrode 5, the surface electrode 5 includes a silver layer 6, and the silver layer 6 is in contact with the silicone resin layer 4.

The electron emission element 20 of this embodiment can have an insulating layer 8 having an opening that defines an electron emission region of the electron emission element 20.

The electron emission element 20 is an element that emits electrons from the electron emission region of the surface electrode 5 into air, gas, a reduced pressure atmosphere, and the like. The electrons emitted from the electron emission region charge gas to generate anions in air, gas, reduced pressure atmosphere, and the like. The electron emission element 20 can be used for an ion generator, an ion mobility analyzer, a cell stimulator, a charging device that negatively charges an object to be charged, and an electron beam curing device that cures an object to be cured, a blower, a cooling device, a self light emitting device that emits light from a luminous body, or the like.

The lower electrode 3 is an electrode located on a lower side of the silicone resin layer 4. The lower electrode 3 may be a metal plate, or may be a metal layer or a conductor layer provided on a substrate 2.

When the lower electrode 3 is made of a metal plate, this metal plate may be a substrate of the electron emission element 20. The lower electrode 3 is, for example, an aluminum plate, a stainless steel plate, a nickel plate, or the like. The thickness of the lower electrode is, for example, 200 μm or more and 2 mm or less.

When the lower electrode 3 is provided on the substrate 2, the substrate 2 is, for example, a glass substrate, a ceramic substrate, or the like. The thickness of the substrate 2 is, for example, 200 μm or more and 2 mm or less.

The lower electrode 3 can be formed on the substrate 2 by, for example, a sputtering method, a vapor deposition method, plating, a CVD method, or the like.

The lower electrode 3 may be a single layer electrode or a laminated electrode. The lower electrode 3 can include, for example, an aluminum layer, a gold layer, a copper layer, or the like. The lower electrode 3 may be a MoN/Al/MoN laminated electrode. The thickness of the lower electrode 3 is, for example, 200 nm or more and 1 μm or less.

The insulating layer 8 is a layer made of an insulator provided on the lower electrode 3 or on the substrate 2. The insulating layer 8 can be omitted.

The insulating layer 8 has an opening that defines the electron emission region of the electron emission element 20. The opening may be circular or square. For example, when the lower electrode 3 is an aluminum substrate, the insulating layer 8 may be an oxide film of the aluminum substrate.

For example, when the lower electrode 3 is provided on the substrate 2, the insulating layer 8 is, for example, a silicon nitride layer, a silicon oxide layer, a silicon oxynitride film, an aluminum oxide layer, or the like. The thickness of the insulating layer 8 is, for example, 0.5 μm or more and 2 μm or less. When the opening that defines the electron emission region is circular, the diameter of the opening can be, for example, 1 mm or more and 50 mm or less. When the opening is square, the length of one side of the opening can be, for example, 1 mm or more and 50 mm or less. The insulating layer 8 can be formed by, for example, a CVD method and a photolithography method. Consequently, it is possible to suppress variation in the thickness of the insulating layer 8 (arithmetic average roughness Ra: less than 0.01), and improve the electron emission characteristics and the life characteristics of the electron emission element 20.

The silicone resin layer 4 is provided on the lower electrode 3. Further, the silicone resin layer 4 can be provided so as to be in contact with the lower electrode 3. The silicone resin layer 4 is a layer in which a current flows due to an electric field formed by a potential difference between the surface electrode 5 and the lower electrode 3.

The silicone resin layer 4 can be provided in the opening of the insulating layer 8. This allows a current to flow only in a region of the silicone resin layer 4 that overlaps the opening of the insulating layer 8, and electrons can be emitted from a region of the surface electrode 5 that overlaps the opening of the insulating layer 8. Therefore, the electron emission region of the surface electrode 5 can be defined by the opening of the insulating layer 8.

The silicone resin layer 4 can be provided so as not to substantially contain conductive fine particles. Consequently, the conductive fine particles do not aggregate or segregate in the silicone resin layer 4. Therefore, it is possible to suppress the sudden breakdown of the electron emission element 20. Further, it is possible to make effective use of an electron emission surface of the surface electrode 5 uniformly, and it is possible to extend the life of the electron emission element 20.

The thickness of the silicone resin layer 4 can be, for example, 0.5 μm or more and 1.25 μm or less. Consequently, it is possible to apply a relatively low voltage between the lower electrode 3 and the surface electrode 5 to emit electrons from the electron emission element 20, and it is possible to improve the life characteristics of the electron emission element 20.

The silicone resin layer 4 can be formed, for example, by application of a silicone resin coating agent substantially not containing conductive fine particles onto the lower electrode 3 (for example, spin coating), and curing of the coating agent. For example, a coating agent containing methyl-based silicone resin can be used to form the silicone resin layer.

The surface electrode 5 is an electrode located on a surface of the electron emission element 20 and is disposed on the silicone resin layer 4. The surface electrode 5 includes the silver layer 6. The surface electrode 5 may be a single layer electrode composed of a silver layer 6, or may be a laminated electrode including a silver layer 6 and a metal layer 7.

The surface electrode 5 can have a thickness of 10 nm or more and 100 nm or less. The surface electrode 5 may have a plurality of openings, gaps, and the like. Electrons that flow through the silicone resin layer 4 can pass through these openings, gaps, and the like, and emit electrons from the electron emission region of the surface electrode 5. Such openings, gaps, and the like can be formed by application of a voltage between the lower electrode 3 and the surface electrode 5 (forming process, initial voltage application).

The silver layer 6 included in the surface electrode 5 is in contact with the silicone resin layer 4. Therefore, it is possible to emit electrons from the electron emission element 20. This is revealed from experiments conducted by inventors of the present invention.

An electron emission mechanism in which electrons are emitted from the electron emission element 20 by providing of the silver layer 6 in contact with the silicone resin layer 4 even when the silicone resin layer 4 does not contain conductive fine particles.

The silver layer 6 is preferably a silver sputtering layer or a silver-deposited film. Consequently, it is possible to control the thickness of the silver layer 6 at a nano-level. The silver sputtering layer is a silver layer formed by sputtering, and the silver-deposited film is a silver layer formed by vapor deposition. When the silver layer 6 is formed by sputtering or vapor deposition, the silver layer 6 is formed so as to be in contact with the silicone resin layer 4.

The thickness of the silver layer 6 is preferably larger than 5 nm and 30 nm or less. This makes it possible to increase an amount of electrons emitted from the electron emission element 20.

The surface electrode 5 is preferably a laminated electrode in which the silver layer 6 and the metal layer 7 are laminated. The metal layer 7 can be a gold layer or a platinum layer. Further, the thickness of the gold layer or the thickness of the platinum layer is preferably 10 nm or more and 20 nm or less. This makes it possible to increase the amount of electrons emitted from the electron emission element 20 and improve the life characteristics of the electron emission element 20.

Second Embodiment

Figure 3:
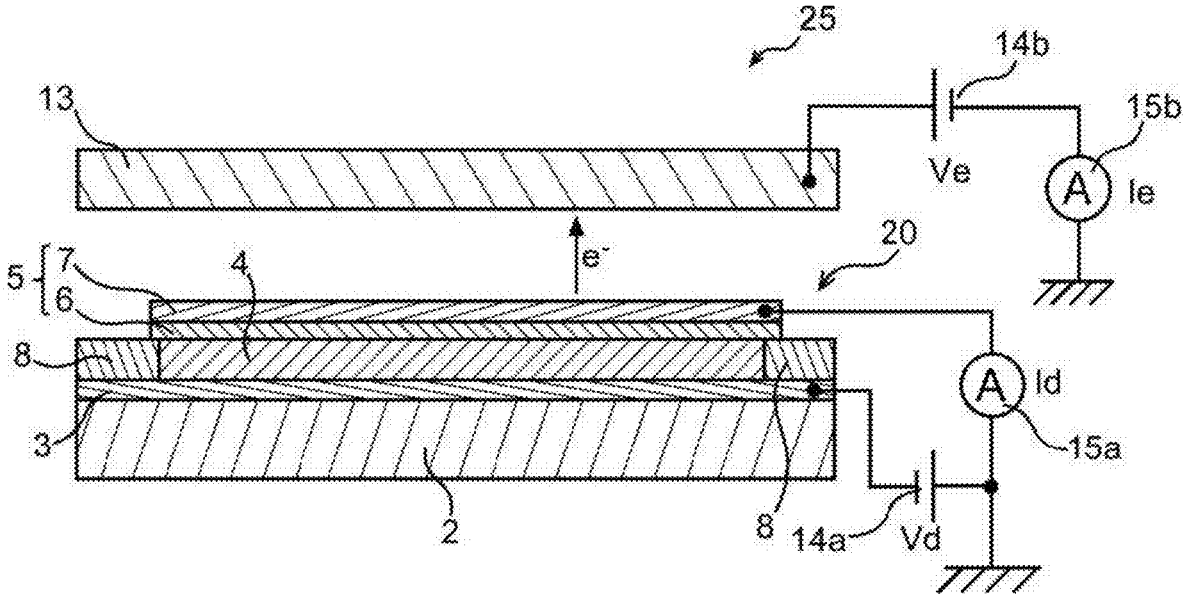
FIG. 3 is a schematic sectional view of the electron emission device according to an embodiment of the present invention.

FIG. 3 is a schematic sectional view of an electron emission device of this embodiment. FIG. 3 also illustrates a circuit diagram illustrating an electrical configuration of the electron emission device.

The electron emission device 25 of this embodiment includes an electron emission element 20, an electric field generating electrode 13, and power supplies 14*a* and 14*b*. The power supply 14*a* is provided so as to apply a voltage between a lower electrode 3 and a surface electrode 5. The power supply 14*b* is provided so as to apply a voltage between the electron emission element 20 and the electric field generating electrode 13.

Further, the electron emission device 25 can include an ammeter 15*a* provided to so as to measure a current that flows between the lower electrode 3 and the surface electrode 5, or an ammeter 15*b* provided so as to measure a current caused to flow by electrons that are emitted from the electron emission element 20 and that reach the electric field generating electrode 13, or by ions that are generated from these electrons and that reach the electric field generating electrode 13.

The electron emission element 20 is described in the First Embodiment, and therefore description of the electron emission element 20 will be omitted here.

The electric field generating electrode 13 is an electrode for generating an electric field between the surface electrode 5 of the electron emission element 20 and the electric field generating electrode 13. The electric field generating electrode 13 and the power supply 14*b* are provided so as to generate such an electric field that electrons emitted from the surface electrode 5 or ions generated by these electrons move in the direction of the electric field generating electrode 13. Further, the ammeter 15*b* is provided so as to measure a current generated by the electrons that are emitted from the surface electrode 5 and that reach the electric field generating electrode 13 or by ions that are generated from these electrons and that reach the electric field generating electrode 13.

An example of operation of the electron emission device 25 will be described.

When a voltage is applied between the lower electrode 3 and the surface electrode 5 by the power supply 14*a*, an electric field is generated in a silicone resin layer 4 between the lower electrode 3 and the surface electrode 5, and electrons of the lower electrode 3 flow through the silicone resin layer 4 toward the surface electrode 5 (current Id). Then, some of the electrons that reach the surface electrode 5 pass through an opening and the like of the surface electrode 5 and are emitted to the outside of the electron emission element 20. The electrons emitted from the surface electrode 5 move toward the electric field generating electrode 13 by the electric field generated by the electric field generating electrode 13. In addition, the emitted electrons ionize oxygen molecules and the like in the atmosphere to generate oxygen ions. These oxygen ions reach the electric field generating electrode 13 by the electric field and transfer charges to the electric field generating electrode 13. Therefore, the potential of the electric field generating electrode 13 changes and a current Ie flows. The current Ie represents an amount of electrons emitted from the electron emission element 20.

A voltage applied between the lower electrode 3 and the surface electrode 5 is preferably 25 V or less. Consequently, it is possible to suppress the generation of ozone and NOx. Further, the current that flows between the lower electrode 3 and the surface electrode 5 can be adjusted using a PWM circuit.

First Electron Emission Experiment

An element 1 in which a surface electrode 5 was composed of a single-layered silver layer, an element 2 in which a surface electrode 5 was composed of a single-layered gold layer, and an element 3 in which a surface electrode 5 was composed of a single-layered Pt layer were manufactured. Each element structure is the same as that of the electron emission element 20 illustrated in FIG. 1 and FIG. 2 except that the surface electrode 5 is composed of a single layer.

A glass substrate (20 mm×24 mm) with a thickness of 0.7 mm was used for a substrate 2. A lower electrode 3 was a laminated electrode represented by a MoN layer (100 nm)/Al layer (200 nm)/MoN layer (50 nm). The lower electrode 3 was formed by a sputtering method or a CVD method. An insulating layer 8 was a SiN layer. The opening diameter of an opening of the insulating layer 8 was 16 mm. The SiN layer was formed by the CVD method. A photolithography method was used to form the pattern of the electrode 3 and the insulating layer 8.

A silicone resin layer 4 was formed by applying a coating agent (not containing conductive fine particles) containing methyl-based silicone resin into the opening of the insulating layer 8 (on the lower electrode 3) by the spinning method, and curing a coating layer. The surface electrode 5 was formed by sputtering.

An electron emission device 25 as illustrated in FIG. 3 was formed using each of the manufactured elements 1, 2 or 3, and a forming process was performed for each of the elements 1 to 3. A current Ie generated by emission of the electrons from each electron emission element during the forming process was measured. The forming process was performed in a room temperature environment (R/R environment, a temperature of 20° C. to 25° C., relative humidity of 25% to 45%).

In the forming process, when a voltage Vd applied between the lower electrode 3 and the surface electrode 5 was changed from 0 V to 25 V at a boosting speed of 0.1 V/sec, and reached 25 V, the voltage Vd was reduced to 0 V. The change in the applied voltage Vd was repeated 3 times.

Figure 4:
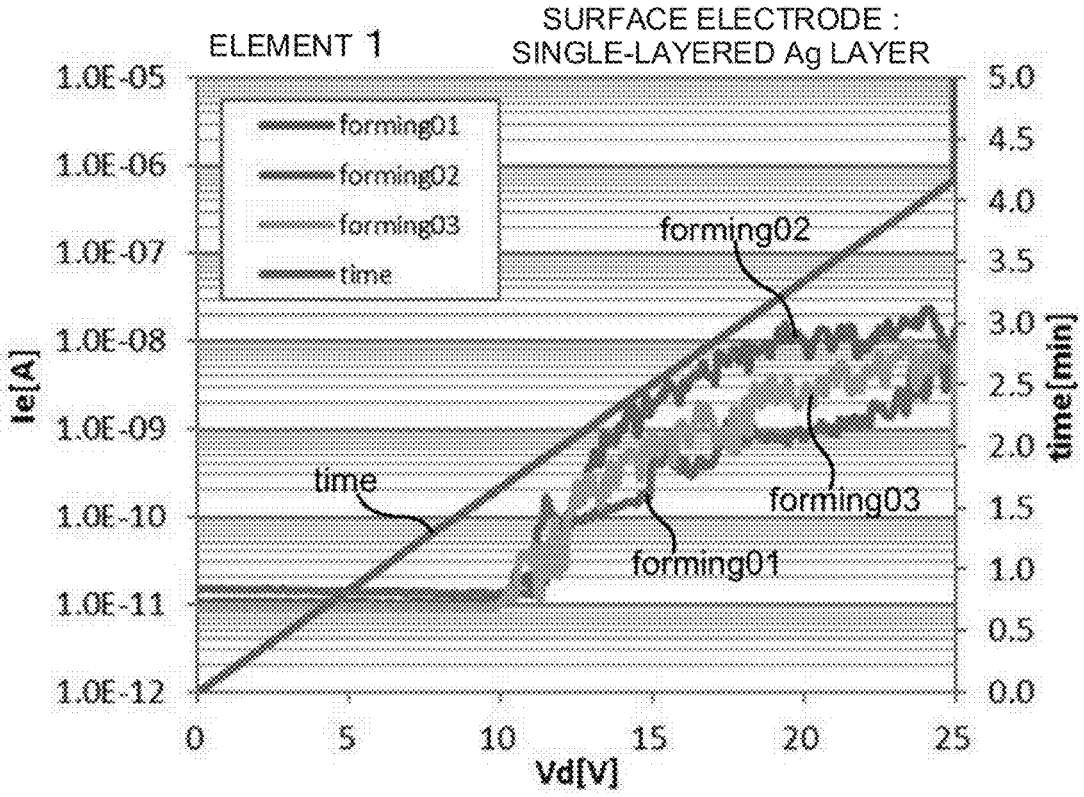
FIG. 4 is a graph illustrating change in a current Ie during a forming process of an element 1.
Figure 5:
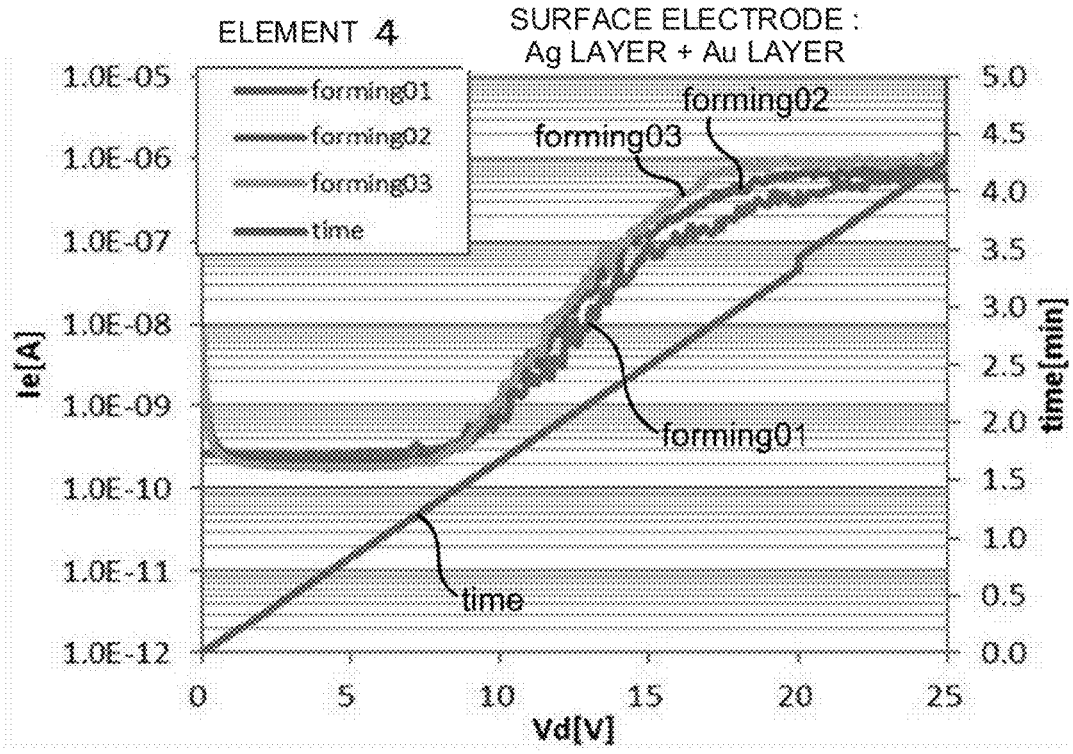
FIG. 5 is a graph illustrating change in a current Ie during a forming process of an element 4.
Figure 6:
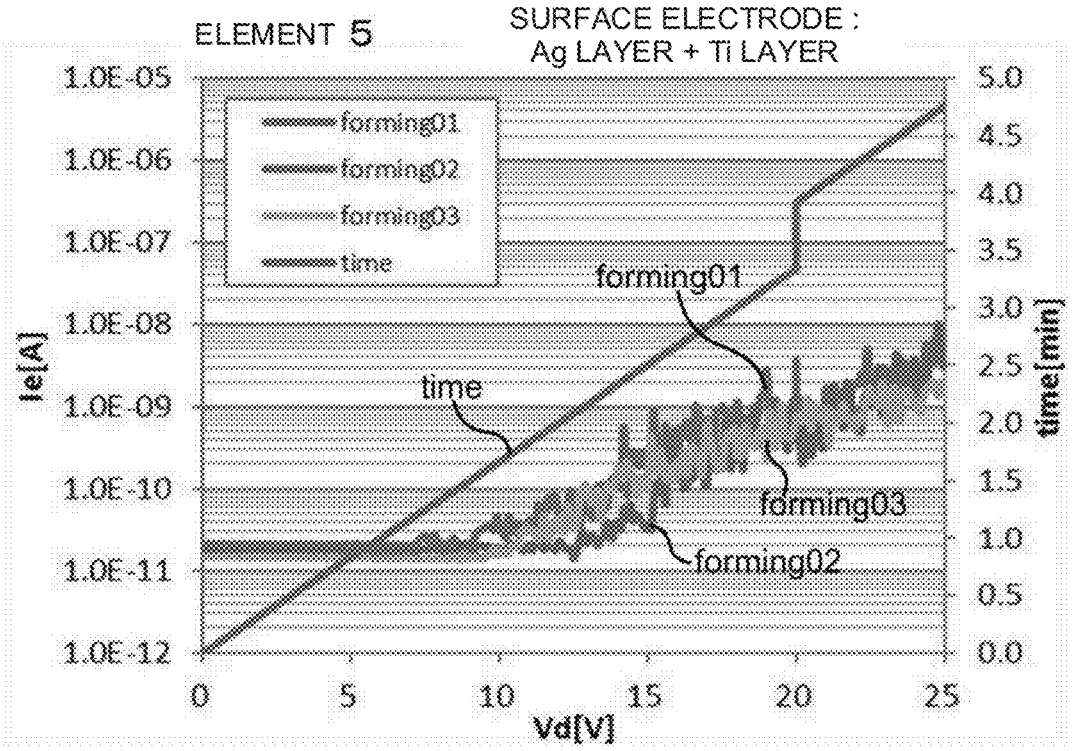
FIG. 6 is a graph illustrating change in a current Ie during a forming process of an element 5.
Figure 7:
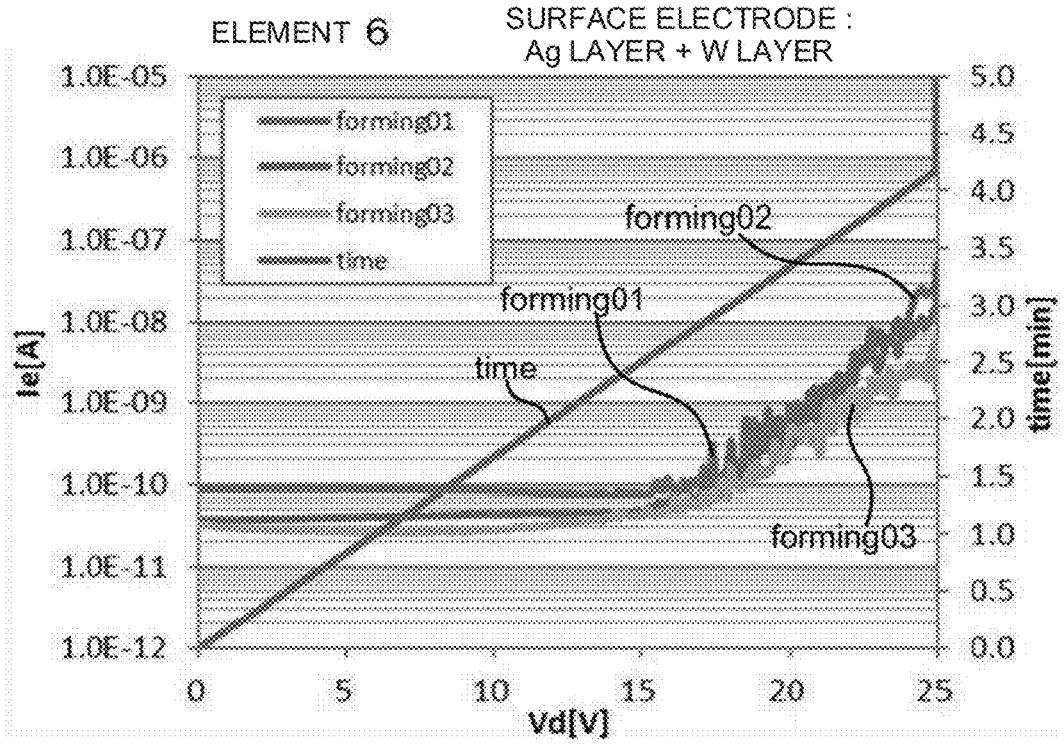
FIG. 7 is a graph illustrating change in a current Ie during a forming process of an element 6.
Figure 8:
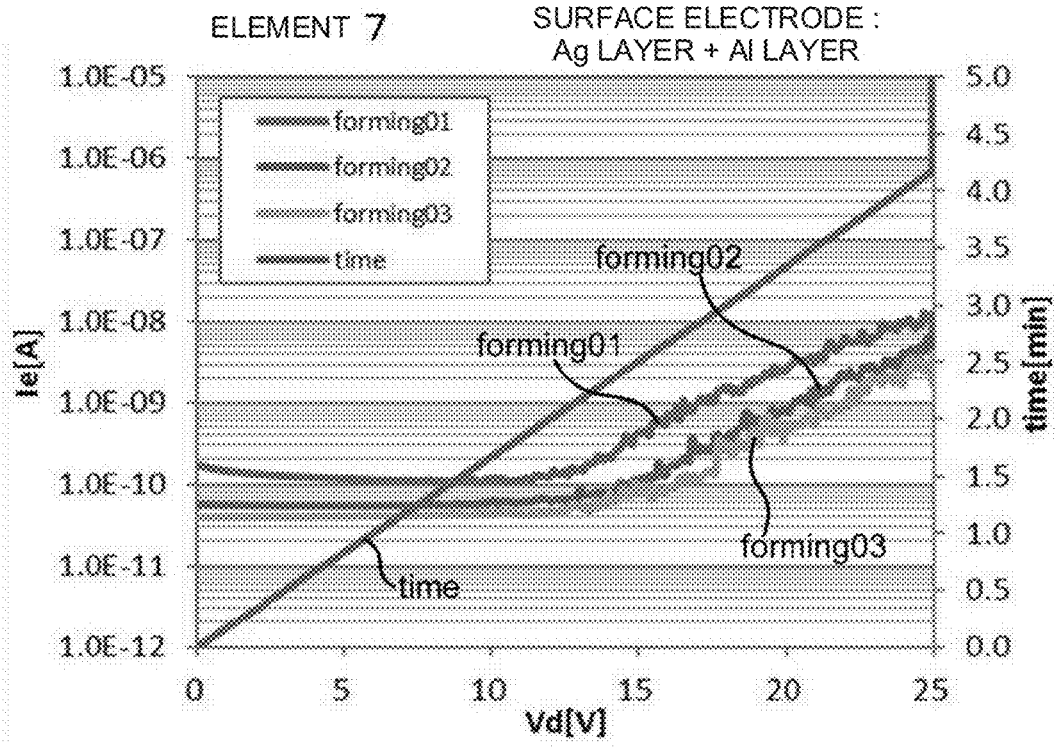
FIG. 8 is a graph illustrating change in a current Ie during a forming process of an element 7.
Figure 9:
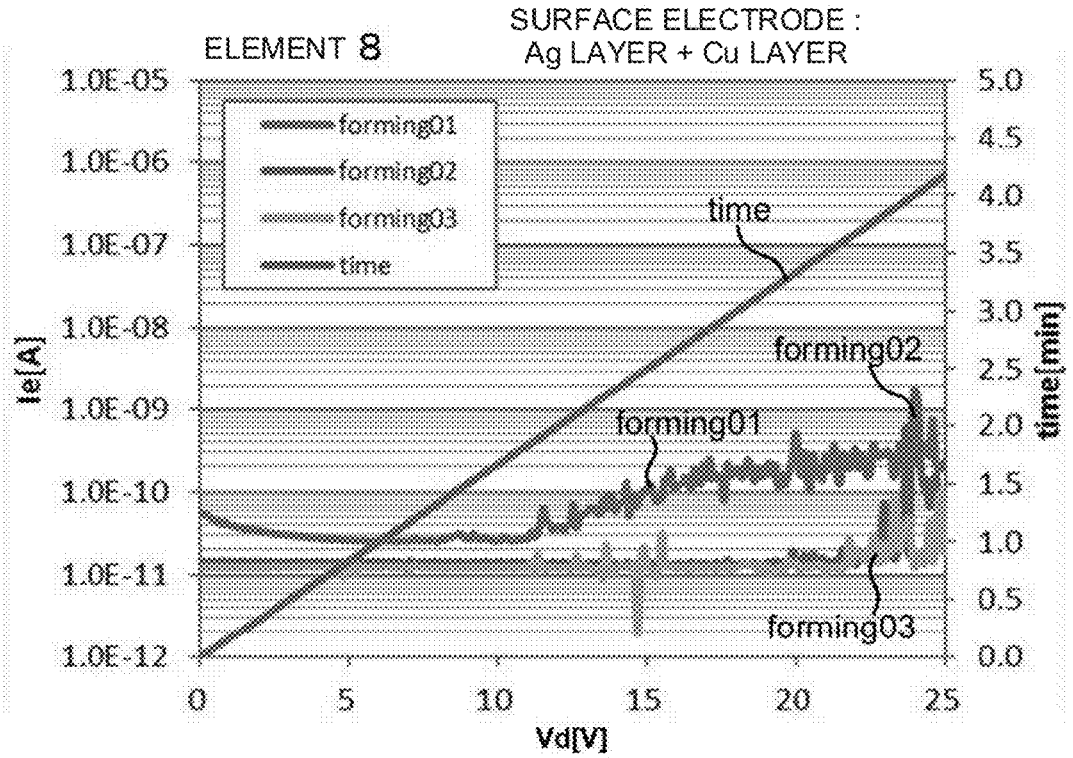
FIG. 9 is a graph illustrating change in a current Ie during a forming process of an element 8.
Figure 10:
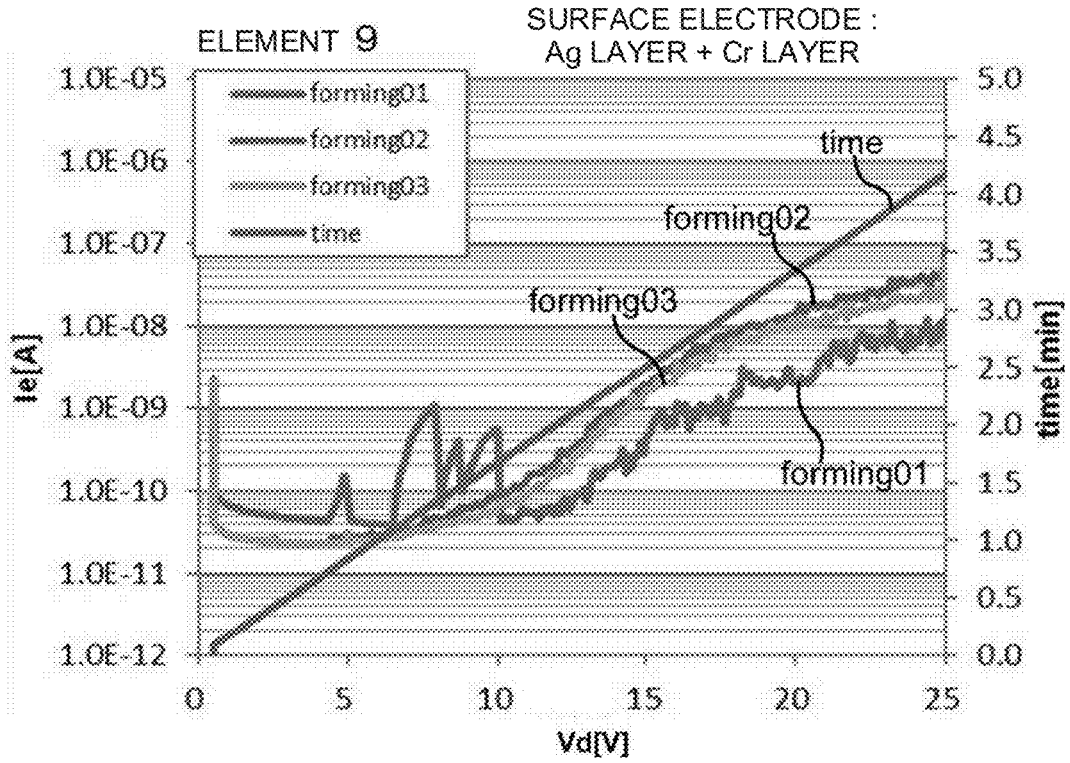
FIG. 10 is a graph illustrating change in a current Ie during a forming process of an element 9.
Figure 11:
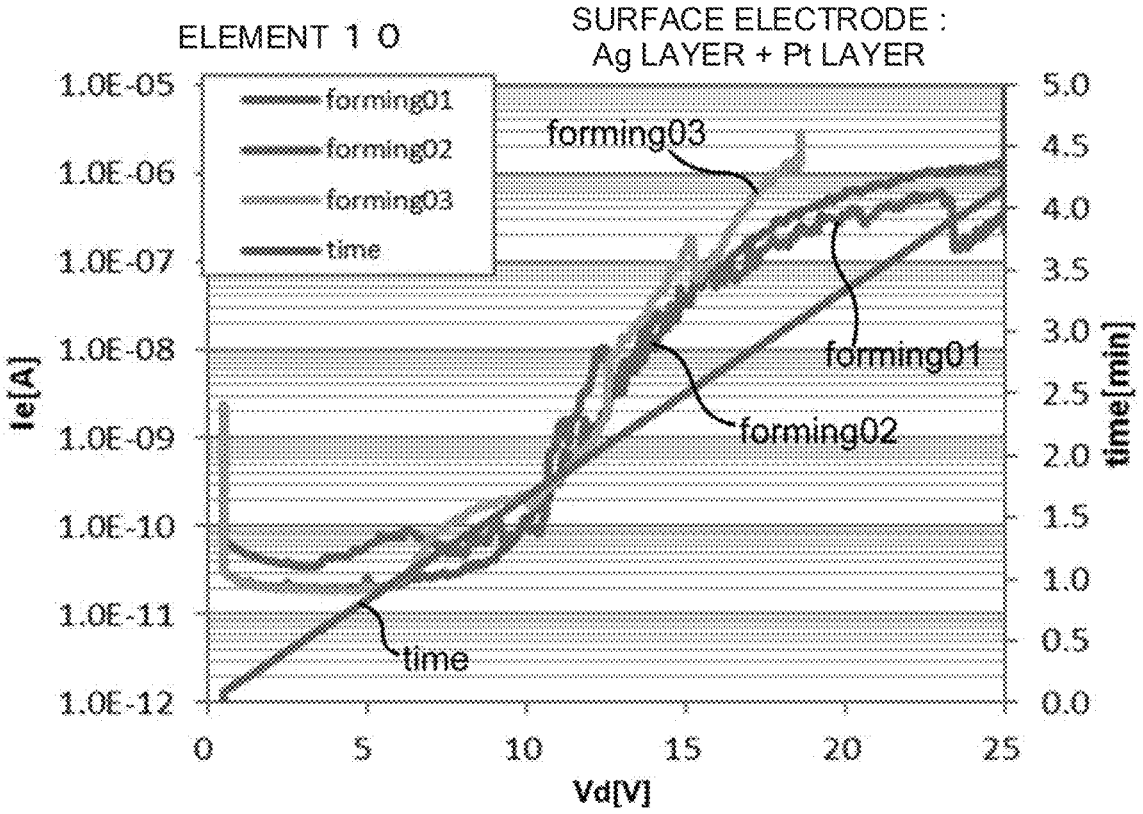
FIG. 11 is a graph illustrating change in a current Ie during a forming process of an element 10.

Table 1 illustrates the thickness of the silicone resin, the type of the surface electrode, the thickness of the surface electrode, and the presence or absence of electron emission in each of the manufactured elements 1 to 3. In addition, a graph illustrating change in the current Ie during the forming process of the element 1 is illustrated in FIG. 4.

In the element 1, increase in the current Ie was measured and electron emission was confirmed. However, in each of the elements 2 and 3, increase in the current Ie was not measured and electron emission was not confirmed.

TABLE 1

| | Thickness of Silicone Resin Layer | Surface Electrode | Thickness of Surface Electrode | Electon Emission |
|---|---|---|---|---|
| Element 1 | 0.5 μm | Single Layered Ag Layer | 10 nm | presence |
| Element 2 | 0.5 μm | Single Layered Au Layer | 10 nm | absence |
| Element 3 | 0.5 μm | Single Layered Pt Layer | 10 nm | absence |

From these results, it has been found that even when the silicone resin layer 4 does not contain conductive fine particles, electrons can be emitted from the electron emission element by providing of the silver layer in contact with the silicone resin layer.

It is not clear why electrons are emitted from the surface electrode in the element 1, but electrons are not emitted from the surface electrode in each of the elements 2 and 3.

Second Electron Emission Experiment

In the second electron emission experiment, elements 4 to 10 each having a laminated electrode of a silver layer 6 and a metal layer 7 as a surface electrode 5 were manufactured. Each silver layer 6 was disposed on a silicone resin layer 4, and each metal layer 7 was disposed on the silver layer 6.

The metal layer of the element 4 was a gold layer, the metal layer of the element 5 was a titanium layer, the metal layer of the element 6 was a tungsten layer, the metal layer of the element 7 was an aluminum layer, and the metal layer of the element 8 was a copper layer, the metal layer of the element 9 was a chrome layer, and the metal layer of the element 10 was a platinum layer.

In each of the elements 4 to 10, the thickness of the silicone resin layer 4 was 0.5 μm, the thickness of the silver layer was 10 nm, and the thickness of the metal layer was 10 nm. The silver layer and the metal layer were formed by a sputtering method. Each element structure is the same as that of the electron emission element 20 illustrated in FIGS. 1 and 2. Other element configurations and manufacturing methods are the same as those of the first electron emission experiment.

An electron emission device 25 as illustrated in FIG. 3 was manufactured by using each of the manufactured elements 4 to 10, and a forming process was performed for each of the elements 4 to 10. A current Ie generated by emission of electrons from each electron emission element during the forming process was measured. A method of the forming process is the same as that of the first electron emission experiment.

In addition, an aging experiment in which the elements 4 and 10 were each driven for a long time was conducted. In the aging experiment, a voltage Vd applied between a lower electrode 3 and the surface electrode 5 was changed such that the current Ie generated by emission of the electrons from each electron emission element was a target value of $1.2\times10^{-6}$ A. A current that flows between the lower electrode 3 and the surface electrode 5 was adjusted by PWM control (duty ratio: 50% constant). The aging experiment was conducted in a room temperature environment (R/R environment, a temperature of 20° C. to 25° C., relative humidity of 25% to 45%).

Figure 12:
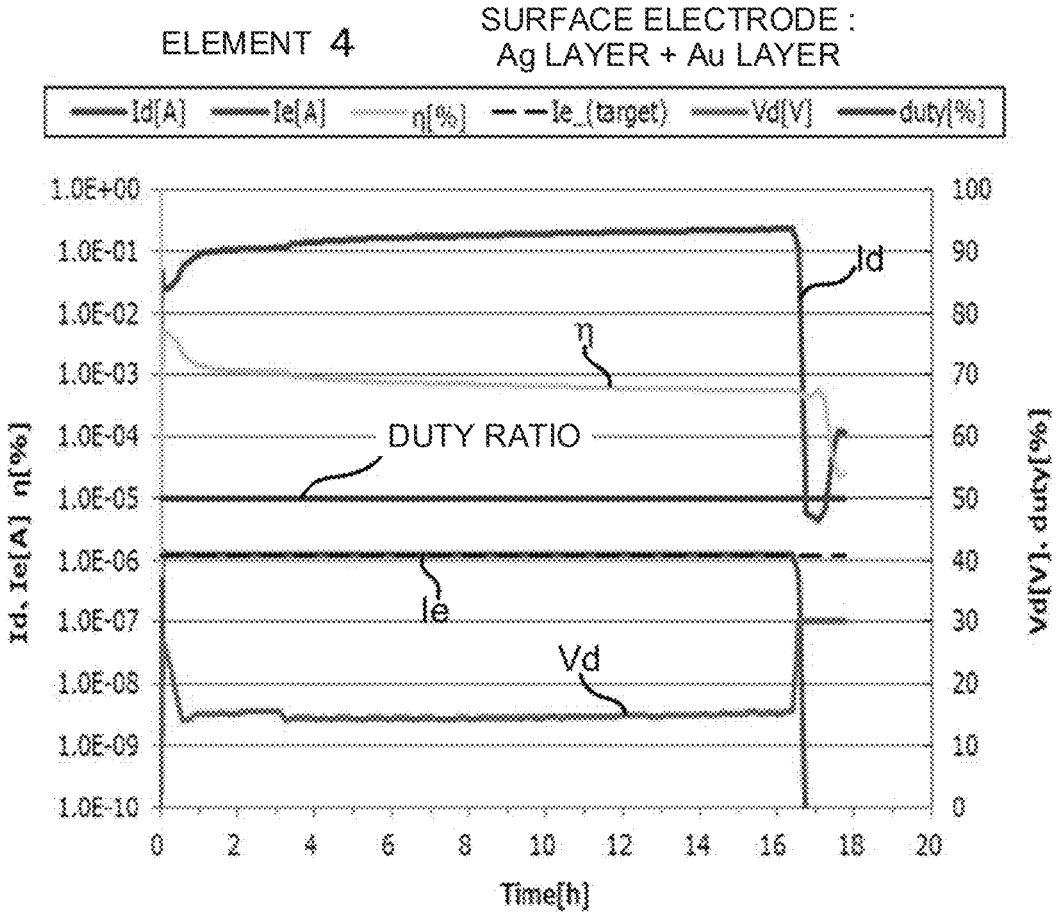
FIG. 12 is a graph illustrating a measurement result of an aging experiment for the element 4.
Figure 13:
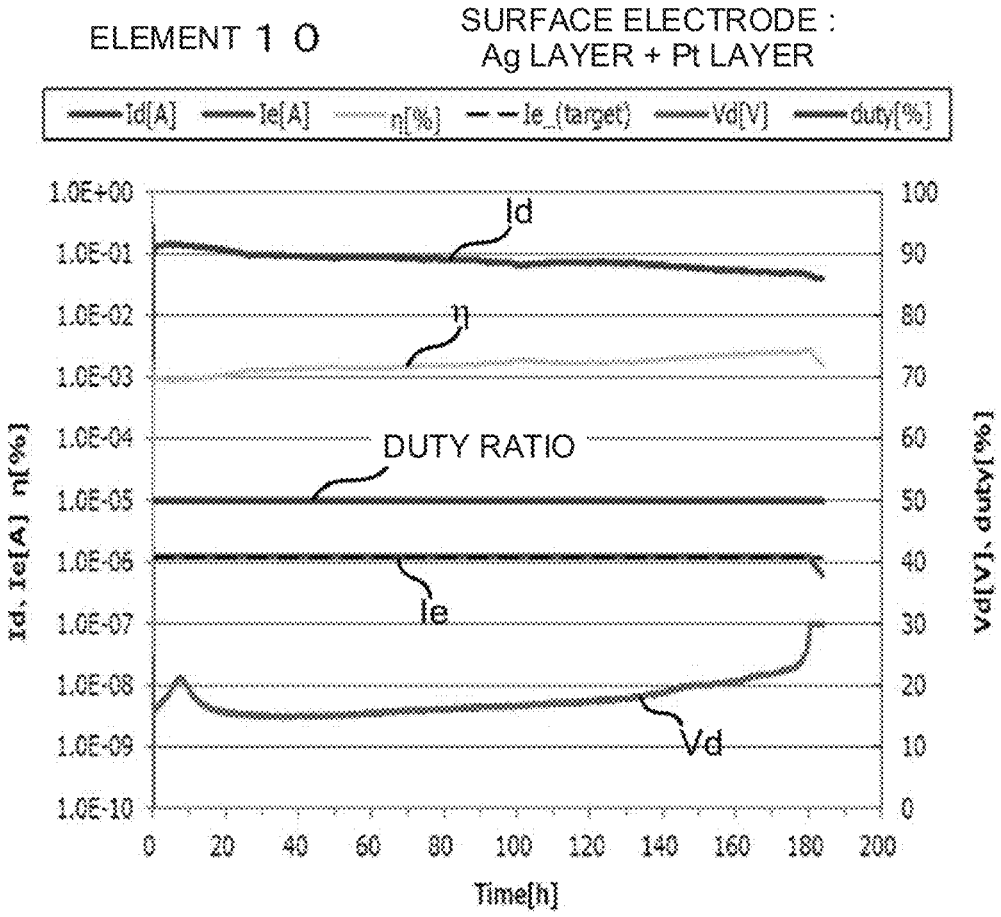
FIG. 13 is a graph illustrating a measurement result of an aging experiment for the element 10.

Respective graphs illustrating change in the currents Ie during the forming processes of the elements 4 to 10 are illustrated in FIGS. 5 to 11. In each of FIGS. 5 to 11, each of curves denoted by forming01 to forming03 illustrates change in a current Ie in boosting of the forming process. The results of the aging experiments of the elements 4 and 10 are illustrated in FIGS. 12 and 13. In each of FIGS. 12 and 13, a curve denoted by Id is a curve illustrating change in a current that flows between the lower electrode 3 and the surface electrode 5, a curve denoted by Ie is a curve illustrating change in the current that generated by emission of electrons from the electron emission element, and a curve denoted by η is a curve illustrating change in electron emission efficiency, and a curve denoted by Vd is a curve illustrating change in the voltage applied between the lower electrode 3 and the surface electrode 5.

From the measurement results illustrated in FIGS. 5 to 11, it has been found that increase in the current Ie is measured in all the elements 4 to 10. From this, it has been found that even when the silicone resin layer 4 does not contain conductive fine particles and the surface electrode 5 is the laminated electrode, electrons can be emitted from the electron emission element by providing of the silver layer in contact with the silicone resin layer. Furthermore, it has been found that an amount of electrons emitted from the element 4 (the silver layer+the gold layer), and an amount of electrons emitted from the gold layer) and the amount of electrons emitted from the element 10 (the silver layer+the platinum layer) increases. In addition, it has been found that the elements 4 and 10 have excellent electron emission characteristics compared to the element 1 (single-layered silver layer).

Further, from the measurement results of the aging experiments illustrated in FIGS. 12 and 13, it has been found that target emission amount maintenance time of the element 4 is about 16 hours and the target emission amount maintenance time of the element 10 is about 180 hours. From this, it has been found that the element 4 and the element 10 have excellent life characteristics.

Third Electron Emission Experiment

In a third electron emission experiment, elements 11 to 19 each having a laminated electrode of a silver layer 6 and a gold layer as a surface electrode 5 were manufactured. Each silver layer 6 was disposed on a silicone resin layer 4, and each gold layer was disposed on the silver layer 6.

Table 2 illustrates the thickness of the silicone resin layer 4, the thickness of the silver layer, and the thickness of the gold layer for each of the elements 11 to 19. Each element structure is the same as that of the electron emission element 20 illustrated in FIGS. 1 and 2. Other element configurations and manufacturing methods are the same as that of the first or second electron emission experiment.

An electron emission device 25 as illustrated in FIG. 3 was manufactured by using each of the manufactured elements 11 to 19, and an aging experiment in which each of the devices 11 to 19 was driven for a long time was conducted. A method of the aging experiment is the same as that of the second electron emission experiment. The experimental results are shown in Table 2. Table 2 also shows the result of the aging experiment of the element 4.

TABLE 2

| | Thickness of Silicone Resin Layer | Thickness of Ag Layer | Thickness of Au Layer | Electron Emission | Target Emission Amount Maintenance Time |
|---|---|---|---|---|---|
| Element 11 | 1 μm | 10 nm | 20 nm | presence | 450 h |
| Element 12 | 1.25 μm | 10 nm | 20 nm | presence | 680 h |
| Element 13 | 0.75 μm | 10 nm | 20 nm | presence | 205 h |
| Element 14 | 0.5 μm | 10 nm | 20 nm | presence | 87 h |
| Element 15 | 1 μm | 5 nm | 20 nm | presence | not yet reach target |
| Element 16 | 1 μm | 20 nm | 20 nm | presence | 130 h |
| Element 17 | 1 μm | 30 nm | 20 nm | presence | 66 h |
| Element 18 | 1.25 μm | 20 nm | 20 nm | presence | 86 h |
| Element 19 | 0.5 μm | 30 nm | 20 nm | presence | 0.5 h or less |
| Element 4 | 0.5 μm | 10 nm | 10 nm | presence | 16 h |

From these results, it has been found that target emission amount maintenance time is 10 hours or more for each of the elements 4, 11 to 14, 16 to 18. In particular, the target emission amount maintenance time exceeded 400 hours in each of the elements 11 and 12. Therefore, it has been found that the electron emission element has excellent electron emission characteristics by using the laminated electrode of the silver layer and the gold layer as the surface electrode 5.

From these results, It has been found that the thickness of the silicone resin layer 4 is preferably 0.5 μm or more and 1.25 μm or less, the thickness of the silver layer 6 is preferably larger than 5 nm and 30 nm or less, and the thickness of the gold layer is preferably 10 nm or more and 20 nm or less. It has been also found that when the thickness of the silicone resin layer 4 is 0.5 μm or less, the thickness of the silver layer 6 is preferably smaller than 30 nm.

Fourth Electron Emission Experiment

In the fourth electron emission experiment, elements 20 to 22 each having a laminated electrode of a silver layer 6 and a platinum layer as a surface electrode 5 were manufactured. Each silver layer 6 was disposed on a silicone resin layer 4, and each platinum layer was disposed on the silver layer 6.

Table 3 illustrates the thickness of the silicone resin layer 4, the thickness of the silver layer, and the thickness of the platinum layer for each of the elements 20 to 22. Each element structure is the same as that of the electron emission element 20 illustrated in FIGS. 1 and 2. Other element configurations and manufacturing methods are the same as that of the first, second or third electron emission experiment.

An electron emission device 25 as illustrated in FIG. 3 was manufactured by using each of the manufactured elements 20 to 22, and an aging experiment in which each of the devices 20 to 22 was driven for a long time was conducted. A method of the aging experiment was the same as that of the second or third electron emission experiment. The experimental results are shown in Table 3. Table 3 also shows the result of the aging experiment of the element 10.

From these results, it has been found that target emission amount maintenance time was 90 hours or more in each of the elements 10 and 20 to 22. In particular, the target emission amount maintenance time exceeded 200 hours in each of the elements 21 and 22. Therefore, it has been found that the electron emission element has excellent electron emission characteristics by using the laminated electrode of the silver layer and the platinum layer as the surface electrode 5.

TABLE 3

| | Thickness of Silicone Resin Layer | Thickness of Ag Layer | Thickness of Pt layer | Electron Emission | Target Emission Amount Maintenance Time |
|---|---|---|---|---|---|
| Element 20 | 1 μm | 10 nm | 20 nm | presence | 97 h |
| Element 21 | 0.75 μm | 10 nm | 20 nm | presence | 362 h |
| Element 22 | 0.5 μm | 10 nm | 20 nm | presence | 230 h |
| Element 10 | 0.5 μm | 10 nm | 10 nm | presence | 180 h |

What is claimed is:

1. An electron emission element comprising:

a lower electrode;

a surface electrode;

a silicone resin layer disposed between the lower electrode and the surface electrode, wherein the surface electrode includes a silver layer, and the silver layer is in contact with the silicone resin layer.

2. The electron emission element according to claim 1, wherein the silver layer is a silver sputtering layer or a silver-deposited film.

3. The electron emission element according to claim 1, wherein a thickness of the silicone resin layer is 0.5 μm or more and 1.25 μm or less, and a thickness of the silver layer is more than 5 nm and 30 nm or less.

4. The electron emission element according to claim 1, wherein the surface electrode is a laminated electrode in which the silver layer and a gold layer or a platinum layer are laminated.

5. The electron emission element according to claim 4, wherein a thickness of the gold layer or a thickness of the platinum layer is 10 nm or more and 20 nm or less.

6. The electron emission element according to claim 1, further comprising a substrate, wherein the lower electrode is disposed on the substrate, the silicone resin layer is disposed on the lower electrode, and the surface electrode is disposed on the silicone resin layer.

* * * * *